US007373703B1

(12) United States Patent
Grenci

(10) Patent No.: US 7,373,703 B1
(45) Date of Patent: May 20, 2008

(54) MEMORIAL PICTURE FRAME

(76) Inventor: Geraldine D. Grenci, 75 Liberta Dr., Toms River, NJ (US) 08757

( * ) Notice: Subject to any disclaimer, the term of this patent is extended or adjusted under 35 U.S.C. 154(b) by 0 days.

(21) Appl. No.: 11/889,114

(22) Filed: Aug. 9, 2007

(51) Int. Cl.
*A61G 17/00* (2006.01)

(52) U.S. Cl. ..... 27/1; 40/722; 40/725; 40/514

(58) Field of Classification Search ..... 27/1; D99/5; 40/124.5, 722, 725, 732, 514, 517
See application file for complete search history.

(56) References Cited

U.S. PATENT DOCUMENTS 2,146,041 A * 2/1939 Wolfson et al. ..... 40/514
4,199,848 A * 4/1980 Kohnert ..... 27/1
5,896,632 A * 4/1999 Sturino ..... 27/1
5,924,869 A * 7/1999 Haas ..... 434/245
5,950,287 A * 9/1999 Cacciatore et al. ..... 27/1
5,950,288 A * 9/1999 Bach Lahor ..... 27/1
6,347,439 B1 * 2/2002 Bach Lahor ..... 27/1
6,526,636 B2 * 3/2003 Bernhardt ..... 27/1
6,735,831 B1 * 5/2004 Greiwe et al. ..... 27/1
7,082,653 B1 * 8/2006 Sueppel ..... 27/1
7,117,570 B1 * 10/2006 Borgerding ..... 27/1
7,191,499 B2 * 3/2007 Davis et al. ..... 27/1
7,302,772 B2 * 12/2007 Harrington ..... 40/725
7,308,740 B2 * 12/2007 Roberts ..... 27/1
2006/0207075 A1 * 9/2006 Davis ..... 27/1

* cited by examiner

*Primary Examiner*—William L. Miller
(74) *Attorney, Agent, or Firm*—Jacobson Holman PLLC

(57) ABSTRACT

A memorial picture frame has an outer frame that houses an image of a decedent and a hollow frame configured to house the decedent's cremated remains. The translucent hollow frame is connected to a front surface of the outer frame so as to frame the housed image and to display the ashes of the decedent. The hollow frame, which has four hollow members each having a closed end, an open end for receiving the ashes of the deceased, and a removable closure member, is detachable from the outer frame so as to facilitate deposit of the decedent's ashes therein. A rotatable device that is configured to house and deployably display a scroll containing information related to the decedent is connected to the outer frame.

17 Claims, 3 Drawing Sheets

MEMORIAL PICTURE FRAME

BACKGROUND OF THE INVENTION

1. Field of the Invention

The present invention relates generally to a picture frame for housing and displaying materials that memorialize a decedent. The invention relates more particularly to a combination picture frame, container for housing cremated remains, and device for housing and displaying information about the decedent.

2. Description of the Prior Art

Various devices that display an image of a decedent and that house the decedent's cremated remains are known. For example, U.S. Pat. No. 5,950,287 to Cacciatore et al. discloses an apparatus for containing cremation ashes and displaying a photograph in a same compartment having a cover 15 with a transparent face 18. U.S. Pat. No. 5,950,288 to Lahor discloses a frame 1 with a transparent glass 2 to protect a photographic sheet 3. An urn body is located behind the photographic sheet.

The prior art does not disclose, however, a memorial frame that not only displays an image of the deceased and houses cremated remains, but that contains displayable information related to the decedent's life.

SUMMARY OF THE INVENTION

The present invention overcomes the above-described limitations of the prior art by providing a memorial frame that displays an image of the decedent, stores cremated remains within a hollow transparent or translucent frame, and houses a displayable scroll of information related to the decedent's life, such as a genealogical record or personal history.

According to a preferred embodiment of the present invention, the memorial device includes both an outer frame that houses an image of the decedent and a hollow frame configured to store the decedent's cremated remains. The hollow frame is detachably connected to a front surface of the outer frame so as to frame the housed image and to display the ashes of the decedent. A rotatable device that is configured to house and deployably display an information scroll is connected to the outer frame, preferably to a rear surface.

One feature of the present invention is that the hollow frame facilitates both the deposit, and the display, of the decedent's ashes. The hollow frame includes four hollow tube-like members each having a closed end, and an open end for receiving the ashes of the deceased. Each hollow member is detachable and includes a removable closure member for closing each open end after the ashes have been deposited therein.

Another feature of the present invention is that the scroll is configured to rotatably deploy so as to display the information contained thereon and to retract so as to be stowed in a scrolled position, preferably on a spindle. The scroll is deployed for display by rotating a spindle knob so as to unwind the scroll from the spindle. The scroll is retracted to the stowed position by rotating the spindle knob so as to wind the scroll back onto the spindle.

Still another feature of the present invention is that the spindle is rotatably and removably supported on the outer frame by a pair of opposed spindle supports. The spindle and attached scroll are therefor removable from the spindle supports so that a user can easily access the scroll in order to make revisions thereto or to replace the original scroll with a new scroll.

It is therefore an object of the present invention to provide a memorial frame that both houses an image of the decedent and serves as a container for storage and preservation of the decedent's cremated remains.

Another object of the present invention is to provide a memorial frame having a detachable hollow frame that facilitates both the deposit, and the display, of the decedent's ashes.

A further object of the present invention is to provide a memorial frame that houses a displayable scroll of information related to the decedent's life, such as a genealogical record or personal history.

Yet another object of the present invention is to provide a memorial frame with a displayable scroll that is removable so that a user can easily access the scroll in order to make revisions thereto or to replace the original scroll with a new scroll.

Still a further object of this invention to be specifically enumerated herein is to provide a memorial frame in accordance with the preceding objects that will conform to conventional forms of manufacture, be of relatively simple construction and easy to use so as to provide a device that will be economically feasible, long lasting, durable in service, relatively trouble free in operation, and a general improvement in the art.

These together with other objects and advantages which will become subsequently apparent reside in the details of construction and operation as more fully hereinafter described and claimed, reference being had to the accompanying drawings forming a part hereof, wherein like reference numbers refer to like parts throughout. The accompanying drawings are intended to illustrate the invention, but are not necessarily to scale.

DETAILED DESCRIPTION OF THE PREFERRED EMBODIMENTS

Figure 1:
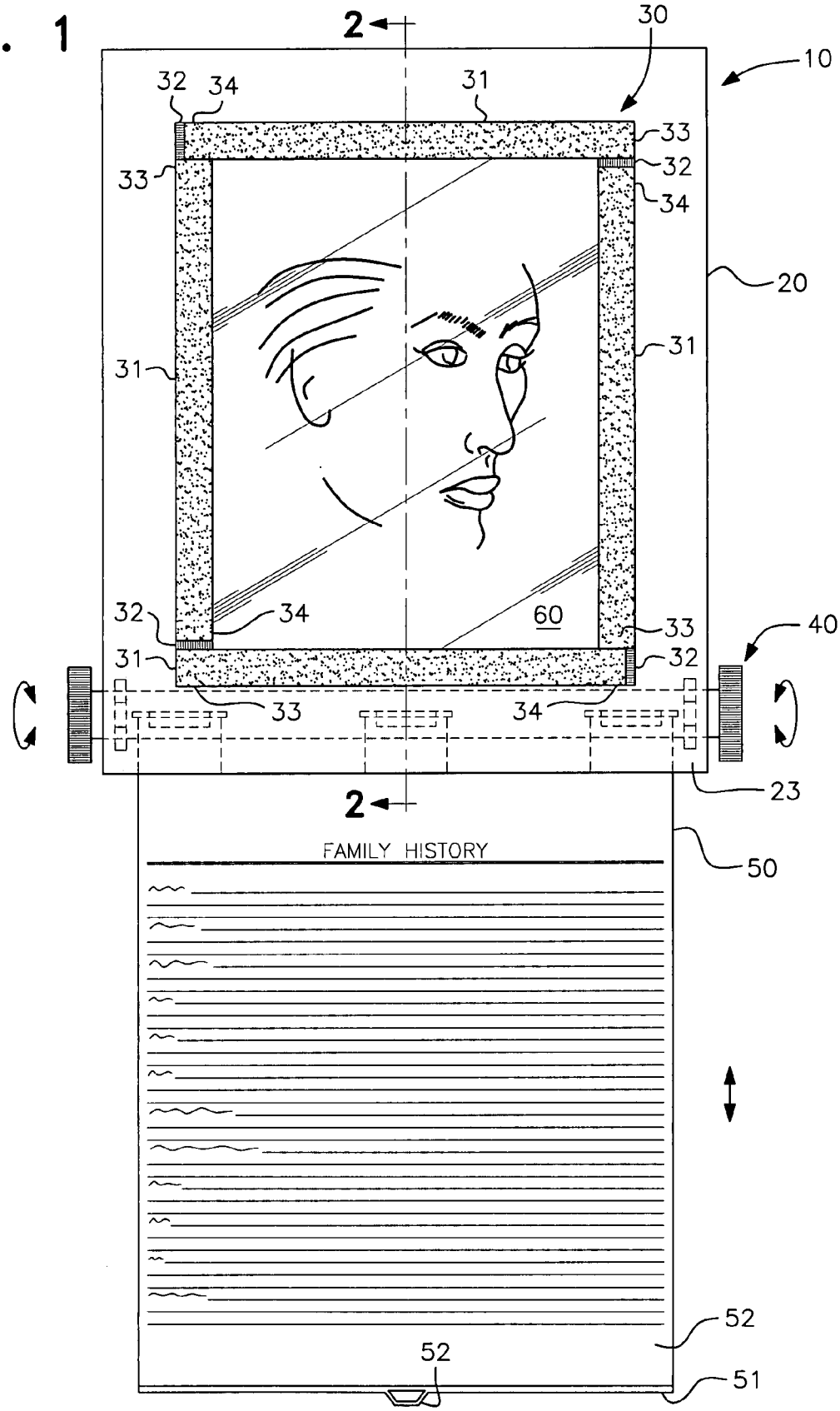
FIG. 1 is a front view diagram illustrating a memorial frame in accordance with a preferred embodiment of the present invention.

Although preferred embodiments of the invention are explained in detail, it is to be understood that other embodiments are possible. Accordingly, it is not intended that the invention is to be limited in its scope to the details of constructions, and arrangement of components set forth in the following description or illustrated in the drawings. The invention is capable of other embodiments and of being practiced or carried out in various ways. Also, in describing the preferred embodiments, specific terminology will be resorted to for the sake of clarity. It is to be understood that each specific term includes all technical equivalents which operate in a similar manner to accomplish a similar purpose. Where possible, components of the drawings that are alike are identified by the same reference numbers.

Referring now specifically to FIG. 1 of the drawings, a memorial picture frame in accordance with the present invention is generally designated by reference number 10.

The frame 10 includes generally an outer frame 20, a hollow frame 30 configured to store cremated remains, and a rotatable device 40 configured to house and display an information scroll 50.

According to a preferred embodiment of the invention, the outer frame 20 is substantially rectangular in shape, is configured to house an image 60 of the decedent therein, and is constructed of a decorative metal material. A front surface of the image 60 is supported in the outer frame 20 by conventional picture frame mounting materials such as a mat and a layer of glass (not illustrated). As an example of the dimensions of outer frame 20 to be used to house an 8 inch×10 inch image, it is contemplated that the width of each of the four sides of the frame 20 is approximately 2.25 inches, with an overall outer frame width of approximately 12.5 inches and an overall outer frame height of approximately 14.5 inches.

The hollow frame 30 is correspondingly substantially rectangular in shape and frames the image 60 that is mounted in the outer frame 20. The hollow frame 30 includes four hollow tube-like members 31 each having a closed end 33, and an open end 34 for receiving and storing the ashes of the deceased. Each hollow member 31 includes a removable closure member 32 for closing each open end 34 after the ashes have been deposited therein. According to a preferred embodiment of the invention, each hollow member 31 is circular in cross section and is constructed of a transparent or translucent material so as to facilitate display of the ashes of the decedent, if desired.

Figure 2:
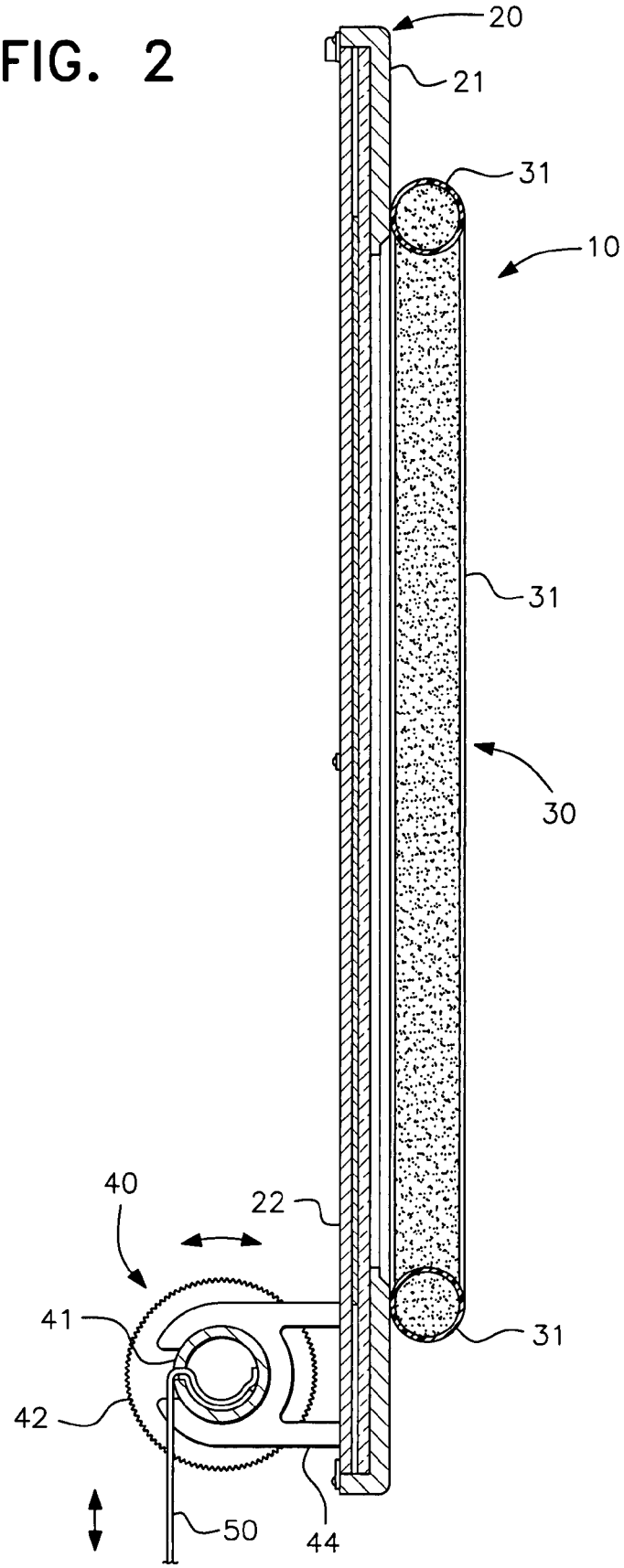
FIG. 2 is a side view diagram of the memorial frame illustrated in FIG. 1.
Figure 3:
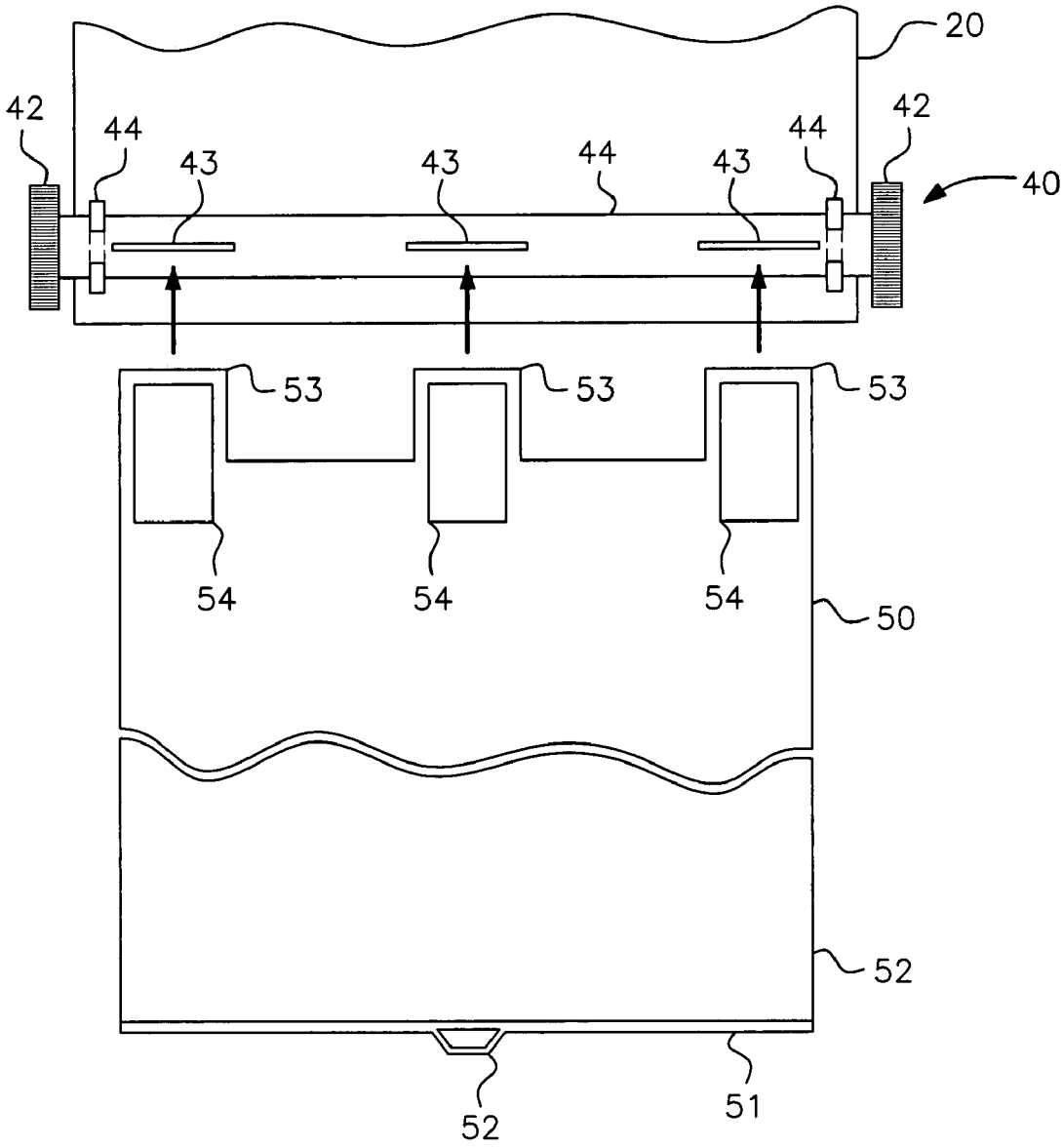
FIG. 3 is a rear view diagram of the memorial frame illustrated in FIG. 1.

As illustrated in FIG. 1 and FIG. 2, the hollow frame 30 is connected to a front surface 21 of the outer frame 20 so as to frame the housed image 60. The hollow frame 30 is detachable from the outer frame 20 to facilitate deposit of a decedent's ashes therein. For use with an outer frame 20 having the above-described dimensions, it is contemplated that each hollow member 31 has an outer diameter of approximately 0.75 inch so that an exposed portion of each of the four sides of the frame is approximately 1.5 inches. Each of the hollow members 31 is also separately detachable from the outer frame 20 to facilitate deposit of a decedent's ashes therein. Each hollow member 31 is attachable to the outer frame 20 by mechanical means, such as, for example, a clamping device such as a latch or a hinge that snaps closed over the hollow member, a slidable locking device, or magnets adhered to each hollow member that are attracted to the metal outer frame.

The rotatable device 40 that is configured to house and display the information scroll 50 includes generally a spindle 41 that is rotatably and removably supported by a pair of opposed spindle supports 44. Each of the spindle supports 44 is attached to a lower portion 23 of a rear surface 22 of the outer frame 20. The spindle 41 includes a plurality of slits 43 that are oriented along the axis of the spindle and that are configured to facilitate attachment of the information scroll 50 to the spindle (described in greater detail below).

The information scroll 50 includes a scrollable piece of acid free paper, parchment, or the like that provides a medium for recording information related to the decedent. The recorded information can be, for example, genealogical information or a personal history of the decedent. The scroll 50 includes a plurality of tabs 53 that correspond in number to the plurality of slits 43 in spindle 41 and that facilitate attachment of the scroll 50 to the spindle 41. More specifically, to attach the scroll 50 to the spindle 41, each of the tabs 53 is inserted in a corresponding slit 43 in spindle 41. According to a preferred embodiment of the invention, each of the tabs 53 includes an adhesive coated portion 54. After each of the tabs 53 has been inserted in spindle 41, the spindle is rotated so as to contact each adhesive coated portion 54 with scroll 50 and thereby secure the attachment of the scroll in the spindle 41. For use with an outer frame 20 and a hollow frame 30 having the above-described exemplary dimensions, it is contemplated that the substantially rectangular scroll 50 is approximately 8.5 inches wide by 14 inches long so as to enable the genealogy/history of the deceased to be recorded thereon.

The rotatable device 40 also includes a first and a second spindle knob 42 located at each end of the spindle 41. The scroll 50 is configured to rotatably deploy so as to display the information contained thereon and to retract so as to be stowed in a scrolled position around the spindle 41. The scroll 50 is deployed for display by manually rotating one or both of the spindle knobs 42 so as to unwind the scroll from the spindle 41. The scroll 50 is retracted to the stowed position by manually rotating one or both of the spindle knobs 42 so as to wind the scroll back onto the spindle 41. According to another embodiment of the invention, the rotatable device 40 can include a spring mechanism (not shown), similar to that in a roller shade, to aid in retracting the deployed scroll 50.

A bottom portion 52 of the scroll 50 includes a lightweight metal strip 51 that provides sufficient weight to assist in maintaining the deployed, unwound shape of the scroll. To facilitate a user's ability to deploy and retract the scroll 50, the metal strip 51 preferably includes a grip ring 52.

As indicated above, the spindle 41 is rotatably and removably supported by the pair of opposed spindle supports 44. The spindle 41 and attached scroll 50 are removable from the spindle supports 44 so that a user can easily access the scroll for the purpose of making revisions thereto or replacing the original scroll with a new scroll. The spindle 41 and the attached updated or new scroll 50 are then remounted in spindle supports 44.

It is not intended that the present invention be limited to the specific apparatus and methods described herein. The foregoing is considered as illustrative only of the principles of the invention. Further, since numerous modifications and changes may readily occur to those skilled in the art, it is not desired to limit the invention to the exact construction and operation described and shown. For example, the frame 10 is shown in FIG. 1 as being oriented in a vertical orientation, i.e., in a portrait format. It is equally possible, however, to configure the frame to be oriented in a horizontal orientation, i.e., in a landscape format. Furthermore, the hollow member 31 has been disclosed herein as being circular in cross section. However, it is also possible to configure the hollow member 31 in other cross-sectional shapes, such as, for example, having a semicircular cross section with a flat portion thereof being oriented flush with the front surface 21 of the outer frame 20, or rectangular.

Accordingly, all suitable modifications and equivalents may be resorted to that fall within the scope of the invention as defined by the following claims.

What is claimed is:

1. A cremated remains memorial frame for displaying an image and the cremated remains of a decedent, comprising:

an outer frame that houses the image;

a hollow frame configured to store the cremated remains, the hollow frame being connected to a front surface of the outer frame so as to frame the housed image; and a rotatable device which houses and deployably displays an information scroll, the rotatable device being connected to the outer frame.

2. The cremated remains memorial frame according to claim 1, wherein the hollow frame includes four hollow members each having a closed end and an open end, and a removable closure member for closing each open end.

3. The cremated remains memorial frame according to claim 2, wherein the hollow member is circular in cross section.

4. The cremated remains memorial frame according to claim 2, wherein the hollow member is transparent or translucent.

5. The cremated remains memorial frame according to claim 2, wherein each of the hollow members is separately detachable from the outer frame.

6. The cremated remains memorial frame according to claim 1, wherein the information scroll includes genealogical or personal history information.

7. The cremated remains memorial frame according to claim 1, wherein the rotatable device includes a spindle that is rotatably and removably supported by a pair of opposed spindle supports each attached to a lower portion of a rear surface of the outer frame.

8. The cremated remains memorial frame according to claim 7, wherein the spindle includes a plurality of slits that are oriented along an axis of the spindle and that are configured to facilitate attachment of the information scroll to the spindle.

9. The cremated remains memorial frame according to claim 8, wherein the scroll includes a plurality of tabs that correspond in number to the plurality of slits in the spindle and that are insertable in the spindle slits.

10. The cremated remains memorial frame according to claim 9, wherein each of the tabs includes an adhesive coated portion that contacts the scroll to provide a secure attachment of the scroll to the spindle.

11. The cremated remains memorial frame according to claim 7, wherein the scroll is configured to rotatably deploy so as to display the information contained thereon and to retract so as to be stowed in a scrolled position around the spindle.

12. The cremated remains memorial frame according to claim 7, wherein the rotatable device includes a first and a second spindle knob located at each end of the spindle to facilitate the rotation thereof.

13. The cremated remains memorial frame according to claim 1, wherein the information scroll includes a scrollable piece of acid free paper or parchment that provides a medium for recordation of information related to the decedent.

14. The cremated remains memorial frame according to claim 1, wherein the hollow frame is detachable from the outer frame.

15. The cremated remains memorial frame according to claim 1, wherein the outer frame, the hollow frame, and the information scroll are each substantially rectangular in shape.

16. The cremated remains memorial frame according to claim 1, wherein the rotatable device is connected to a rear surface of the outer frame.

17. A created remains memorial frame for displaying a printed image and the cremated remains of a decedent, comprising:

an outer substantially rectangular metal frame that houses the printed image of the decedent;

a removable substantially rectangular hollow frame configured to store the cremated remains of the decedent, the hollow frame being connected to a front surface of the outer frame so as to frame the housed image and including four transparent or translucent hollow members each having a closed end and an open end, and a removable closure member for closing each open end after the cremated remains have been deposited therein; and a rotatable device which houses and deployably displays a substantially rectangular scroll containing information related to the decedent, the rotatable device being connected to the outer frame.

* * * * *